US008221018B2

(12) United States Patent
Steinhagen et al.

(10) Patent No.: US 8,221,018 B2
(45) Date of Patent: Jul. 17, 2012

(54) PACKAGING SYSTEM AND ROLLER RECEIVING DEVICE FOR A PACKAGING SYSTEM FOR FLUIDS

(75) Inventors: Ingolf Steinhagen, Bunde (DE); Bernd Hackmann, Bunde (DE)

(73) Assignee: Weener Plastik GmbH & Co., Weener (DE)

( * ) Notice: Subject to any disclaimer, the term of this patent is extended or adjusted under 35 U.S.C. 154(b) by 1321 days.

(21) Appl. No.: 10/590,787

(22) PCT Filed: Feb. 25, 2005

(86) PCT No.: PCT/EP2005/002002

§ 371 (c)(1),
(2), (4) Date: Sep. 17, 2007

(87) PCT Pub. No.: WO2005/079621

PCT Pub. Date: Sep. 1, 2005

(65) Prior Publication Data

US 2008/0121751 A1 May 29, 2008

(30) Foreign Application Priority Data

Feb. 25, 2004 (DE) ..... 20 2004 002 906 U

(51) Int. Cl.
*B43K 7/10* (2006.01)

(52) U.S. Cl. ..... 401/216; 401/209; 401/212; 401/213

(58) Field of Classification Search ..... 401/208, 401/209, 212, 213, 216
See application file for complete search history.

(56) References Cited

U.S. PATENT DOCUMENTS

| | | | | |
|---|---|---|---|---|
| 2,749,566 | A * | 6/1956 | Thomas | 401/213 |
| 4,021,125 | A | 5/1977 | Berghahn et al. | |
| 4,359,292 | A * | 11/1982 | Thompson et al. | 401/216 |

FOREIGN PATENT DOCUMENTS

| | | |
|---|---|---|
| DE | 90 12 721 U1 | 9/1992 |
| DE | 102 05 042 A2 | 9/2002 |
| EP | 0 709 039 A1 | 5/1996 |
| WO | WO 2004 098347 | 11/2004 |
| WO | WO 2006 007987 | 1/2006 |
| WO | WO 2006 007988 | 1/2006 |
| WO | WO 2006 007989 | 1/2006 |
| WO | WO 2006 007990 | 1/2006 |
| WO | WO 2006 007991 | 1/2006 |

* cited by examiner

*Primary Examiner* — Steven J Ganey
(74) *Attorney, Agent, or Firm* — Greer, Burns & Crain, Ltd.

(57) ABSTRACT

A roller receiving device for a packaging system for fluids, the packaging system including a container for receiving a fluid; a roller and a roller receiving device for receiving the roller and for holding the roller on the container, the roller receiving device has a first part for receiving the roller, as well as a second part, different from the first part and held on the first part, the first part forming a first sealing segment for sealing the roller receiving device relative to the container, and the second part forming a first holding segment for forming a locking connection between the roller receiving device and the container.

20 Claims, 4 Drawing Sheets

PACKAGING SYSTEM AND ROLLER RECEIVING DEVICE FOR A PACKAGING SYSTEM FOR FLUIDS

BACKGROUND

The present invention relates to a packaging system and a roller receiving device for a packaging system for fluids.

Packaging systems having a roller, as well as roller receiving devices for such rollers, are known. A widely distributed example of such a packaging system is what is known as a deoroller. Known packaging systems of this sort have a container in which the fluid (such as deodorant) is contained, and that is provided with an outlet opening. In the area of this outlet opening, in the known systems a one-piece roller receiving element is provided, also called a fitment. This fitment receives the roller on one side and is fastened to the container on the other side. An area of the roller surface that faces the interior of the container is exposed to the interior of the container, so that fluid can move onto this area from the interior of the container, and an area of the roller surface is exposed towards the outside the container. With the use of such systems, the packaging system is standardly brought into an overhead position, so that fluid moves onto the inwardly exposed surface area of the roller, and by rolling the roller on a surface, such as for example a person's armpit in the case of a deodorant roller, is transported to the external side. Of course, the outwardly exposed or inwardly exposed surface area of the roller migrates during this process, because the roller is retained so as to be movable.

For this purpose, a sufficient amount of play is provided between the roller and the fitment, so that when the roller is rolled during operation the fluid can penetrate to the outside. In addition, a cover is provided by which the sealing system can be sealed during non-use or transport. In the closed state, this cover presses the roller and the fitment against one another in such a way that an essentially tight connection is produced. In addition, the cover has the function of covering the sealing system. In such systems, the roller is held captively in the fitment, in such a way that during normal use it cannot fall out of the fitment. However, the fitment also has a degree of elasticity sufficient to make it possible for the roller to be received in the fitment during assembly; after assembly, holding forces are formed that are sufficient to prevent the roller from springing out of the fitment during normal use.

In these known systems, the roller is made of a hard material. The fitment is made of a soft material; as a rule, LLDPE is used. The container is made of a hard material; as a rule, HDPE is used.

In these known packaging systems, the fitment is held on the container by a snap connection. For this purpose, the fitment and the container each have a holding segment, and the holding segments work together to form the locking connection. In the known systems, the locking connection has, besides its holding function, a sealing function, so that this locking seating provides a sealing of the fitment relative to the container.

In these known packaging systems, when the cover is closed as a rule a good degree of tightness is provided between the fitment and the roller. The tightness between the fitment and the container is mediocre. In these known systems, the locking connection between the container and the fitment is flawed.

SUMMARY

The present invention is based on the object of creating a packaging system having a container, a roller receiving device for receiving a roller, and a roller for dispensing fluid from the interior of the container, in which the roller receiving device is well-sealed relative to the container and is held securely thereon, as well as a roller receiving device for such a packaging system.

BRIEF DESCRIPTION OF THE DRAWINGS

In the following, the present invention is explained on the basis of an exemplary embodiment illustrated by the Figures.

DETAILED DESCRIPTION

Figure 1:
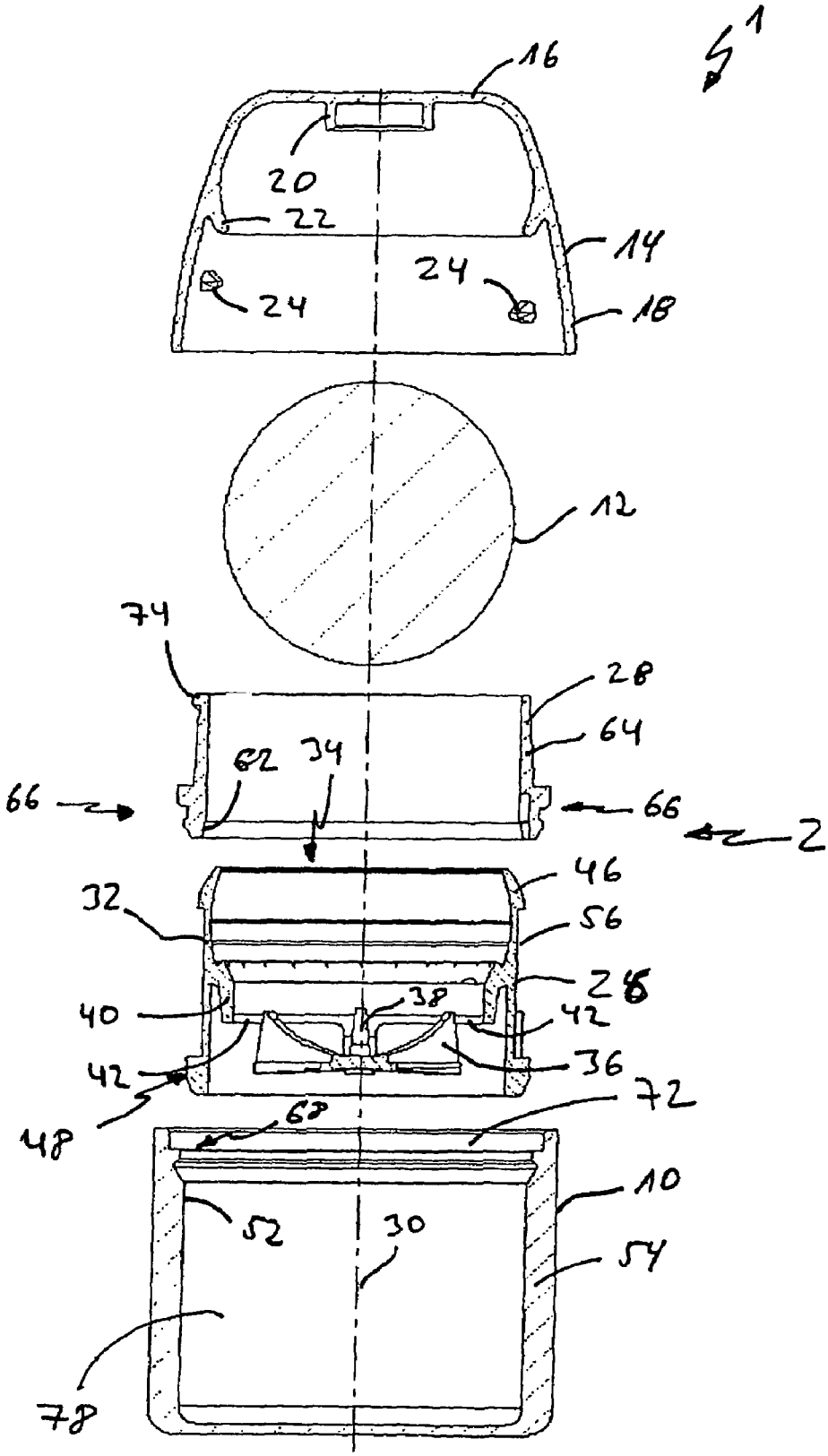
FIG. 1 shows an exploded view of an example of a packaging system according to the present invention, having an example of a roller receiving device according to the present invention.

FIG. 1 shows an example of a packaging system 1 according to the present invention, having an example of a roller receiving device 2 according to the present invention in an exploded view. Packaging system 1, which can also be called a fluid packaging, includes roller receiving device 2, a container 10 which is for example fashioned in the shape of a bowl or as a bottle, and a roller 12. In addition, packaging system 1 has a removable cover 14, which is here fashioned as a cap. Cover 14, which here has a one-piece construction, has an upper wall 16 as well as a peripheral jacket wall 18 connected thereto. Jacket wall 18 is convexly curved outward. On the inner surface, upper wall 16 has a transport securing device 20, fashioned for example as an annular web that protrudes downward. Instead of such an annular web, however, for example a system of a plurality of webs situated at a distance from one another around the periphery can also be provided.

In addition, cover 12 has a pressure device, or pressure part 22. Here, this pressure part 22 is fashioned as an annular web that is situated on the inner surface of jacket wall 18 of cover 14, and that protrudes from this inner surface. This pressure part seals roller receiving device 2 relative to roller 12 when the cover is closed. In addition, cover 14 has holding means 24, fashioned for example as a threading or as a part of a snap connection or locking connection or the like. When the cover is closed, these holding means 24 engage in the unit made up of container 10 and roller receiving device 2 in order to prevent undesired opening of the cover. Corresponding counter-holding means can be situated for example on first part 26 of roller receiving device 2 or on second part 28 of roller receiving device 2 or on container 10. As already indicated, the roller receiving device has a first part 26 and a second part 28 that is different from first part 26.

Roller receiving device 2, which can also be called a fitment device, therefore has in the exemplary embodiment according to FIG. 1 exactly two parts, namely first part 26 and second part 28.

Roller receiving device 2 can also be called a fitment device; first part 26 can be designated a fitment part and second part 28 can be designated a fitment part. Because, in the exemplary embodiment shown in FIG. 1, in the assembled state second part 28 is situated radially externally on first part 26, second part 28 can also be referred to as an outer part or fitment outer part 28, and first part 26 can also be referred to as an inner part or fitment inner part 26.

Figure 2:
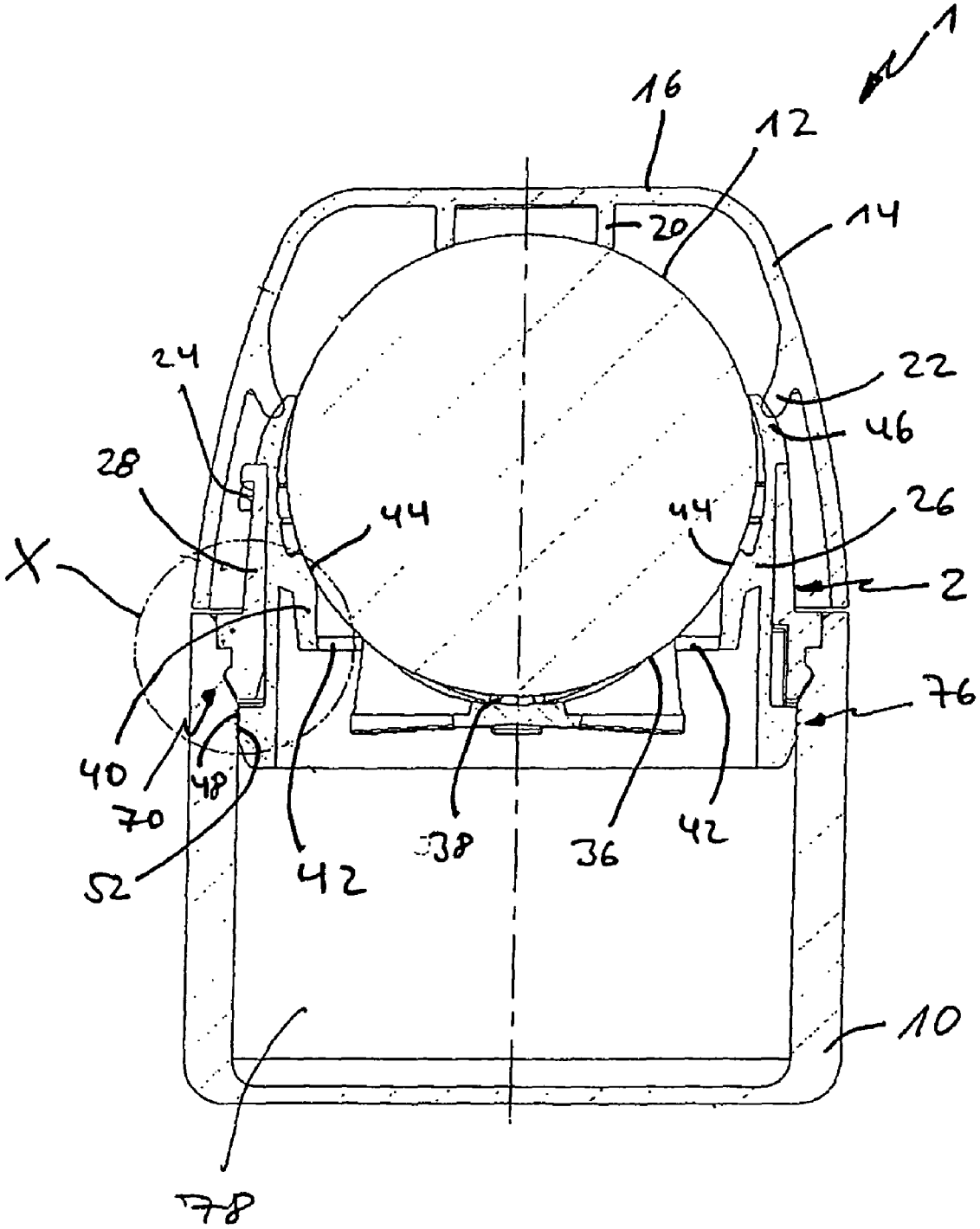
FIG. 2 shows the construction according to FIG. 1 in the assembled state with closed cover.

In relation to the axial direction indicated by broken line 30, fitment inner part 26 is closed around the periphery, and has a jacket wall 32 that is closed around the periphery. Radially inwardly, fitment inner part 26 forms a receiving area 34 that receives roller 12. As is shown in FIG. 2, this receiving area according to the exemplary embodiment is such that roller 12 is received partially, i.e. not completely, in this receiving area. In the exemplary embodiment, this is such that the roller protrudes axially upward from first part 26.

Fitment part 26 has a support part 36 that is situated radially inward and preferably centrally, held by webs 38 on jacket wall 32 or on a segment 40 extending from this wall.

In the exemplary embodiment, support part 36 is concavely curved on the side facing the roller, in such a way that the radius of curvature is less than the radius of curvature of the roller. However, the support part can also be fashioned differently. In the exemplary embodiment, in the radially externally situated areas of support part 36 the roller is supported (as is shown in FIG. 2) on this support part. There, protruding projections 41 can be provided that can for example have a hemispherical shape. It can be provided that roller 12 is supported on these projections 41. Between webs 40, seen in the peripheral direction, pass-through areas or openings 44 for the fluid are formed. Roller 12 is also supported (as is shown in FIG. 2) on areas 44 of segment 40.

In particular on its upper end facing away from the interior of the container, first fitment part 26 has a wall segment 46 that runs towards the inside radially. In the exemplary embodiment, this wall segment 46 forms the upper end of first fitment part 26, and runs inward radially with a curve. Here, this is such that wall segment 46 runs so as to be concavely curved inward radially.

Wall segment 46 is essentially closed continuously in the peripheral direction. This wall segment 46 prevents roller 12 from falling out of first fitment part 26 when cover 14 is opened or removed, in particular in an overhead position. Thus, roller 12 is held captively in first fitment part 26. A flexible or elastic construction in the corresponding areas makes it possible for the roller to be assembled. The corresponding areas are however fashioned such that after assembly the roller is held sufficiently securely in first fitment part 26, and will not fall out under slight loads.

The already-discussed transport securing device 20 is provided on the cover in order to secure the roller additionally against falling out of the first fitment part under larger impacts or loads when cover 14 is closed. This transport securing device 20 can be constructed so that when the cover is closed (as is shown in FIG. 2) it is supported on the roller. However, it can also be provided that a certain intermediate space is provided, which is however sufficient to prevent the roller from falling out or becoming detached from fitment part 26.

Pressure part 22, also already discussed above, presses against wall segment 46 of first fitment part 26 when the cover is closed in such a way that this wall segment 46 is pressed against roller 12 in such a way as to form a seal.

Figure 4:
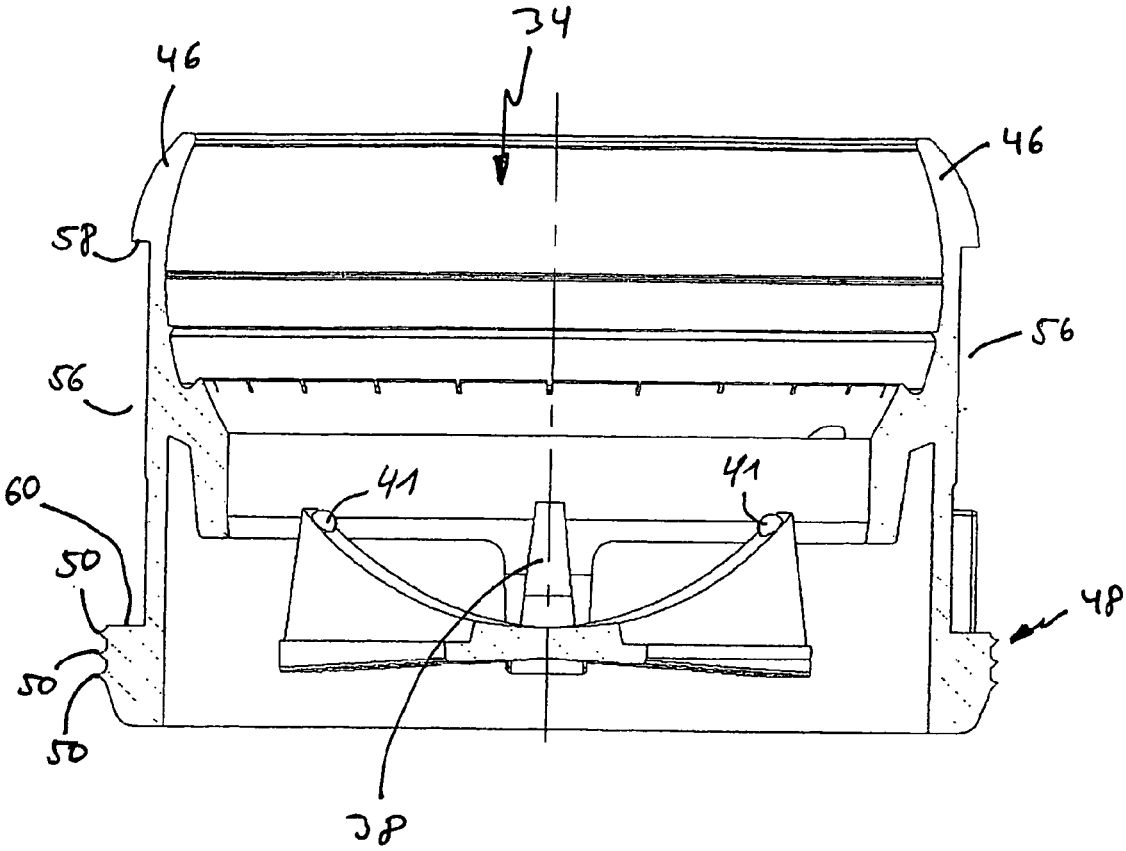
FIG. 4 shows the first fitment part from FIG. 1 or 2 in an enlarged view.

In addition, first fitment part 26 has a first sealing segment 48. In the exemplary embodiment (as is shown in FIG. 4), this sealing segment is formed by a multiplicity of sealing lips 50. These sealing lips 50 extend continuously in the peripheral direction on the first fitment part, and are situated at a distance from one another in the axial direction. The sealing lips are for example situated in a cylindrical surface segment of the first fitment part. In the assembled state, the first sealing segment of fitment part 26, or sealing lips 50, enters into an effective connection with a second sealing segment 52, in order to seal first fitment part 26, or roller receiving device 2, relative to container 10. This second sealing segment is situated on container 10. In the exemplary embodiment, this second sealing segment is formed by an inner surface segment of the jacket wall of container 10. This surface segment of the container has a cylindrical construction.

In the assembled state shown in FIG. 2, second fitment part 28 is held radially externally on first fitment part 26, as is shown in FIG. 2. Second fitment part 28 is held captively in axial fashion in first fitment part 26.

For this purpose, first fitment part 26 has in jacket wall 32 a radially externally situated recess 56 in which second fitment part 28 is received. This recess 56 runs around the periphery, and is limited at its two axially situated ends, i.e., at the end facing the container and the end facing away from the interior of the container, by a respective segment 58 or 60 situated essentially perpendicular to the longitudinal axis or perpendicular to jacket wall 32. Ease of assembly of second fitment part 28 can for example be achieved in that the fitment part is fashioned so as to be elastic at a corresponding point or in its upper area; however, this elasticity should not be such as to enable an easy undesired detaching of second fitment part 28 from first fitment part 26.

In order to make assembly easier, second fitment part 28 has radial inner peripheral starting bevelings 62 on its lower end.

Recess 56 is fashioned axially above first sealing segment 48 of first fitment part 26.

Second fitment part 28 has a peripheral jacket wall 64.

On second fitment part 28, a first holding segment 66 is fashioned. Together with, or cooperating with, a second holding segment 68 situated on container 10, this first holding segment 66 situated on second fitment part 28 forms a locking connection 70. This locking connection 70 holds roller receiving device 2 on container 10.

Because second fitment part 28 is held on container 10 by the locking connection or locking device 70, and second fitment part 28 is in turn held on first fitment part 26, and roller 12 is in addition received or held in first fitment part 26, roller 12 is held on container 10.

In the exemplary embodiment according to the Figures, first holding segment 66 of second fitment part 28, as well as second holding segment 68 of container 10, are respectively formed by surface profiles. The surface profile that forms second holder segment 68 on container 12 is made in the inner surface of the jacket band of container 10, in the upper end area of container 12.

On second fitment part 28, a counter-holding means 74 is situated (radially externally) that, in the closed position of cover 14, works together with a holding element 24 of the cover.

In cooperation with second sealing segment 52, first sealing segment 48 forms a sealing device 76 for sealing roller receiving device 2 relative to container 10.

It is preferably provided that cover 14 has a one-piece construction, and that roller 10 has a one-piece construction, and that first fitment part 26 has a one-piece construction, and that second fitment part 28 has a one-piece construction, and that container 10 has a one-piece construction.

The interior of the container, or container interior space, 78, can contain a fluid, such as for example deodorant or the like.

FIG. 2 shows the construction according to FIG. 1 in the assembled state with closed cover 14. Here it can be seen clearly how, when cover 14 is closed, pressure device 22 presses curved wall segment 46 against roller 12, resulting in a sealing effect. This takes place with elastic deformation. If cover 12 is removed, elastic resetting forces take effect, so that area 46 snaps back at least slightly, so that the sealing effect between first fitment part 26 and roller 12 is removed. Roller 12 is received in first fitment part 26 so as to be movable, in particular capable of rotation. This capability of rotational movement is in particular such that roller 12 can be rotated or can roll in essentially any direction. When cover 14 is removed, this rolling or rotation of roller 12 can, in particular given an overhead positioning of packaging system 1, cause fluid to be moved or transported out of the container to the outside of the container by means of roller 12.

First fitment part 26 is longer in the axial direction than is second fitment part 28. First fitment part 26 protrudes beyond second fitment part 28 in the axial direction, in both orientations.

Container 12 has a container opening 72. Roller receiving device or fitment device 2 is situated in the area of this opening 72. This can for example be such that first fitment part 26 and second fitment part 28 each extend partly into container 12 or container opening 72.

Figure 3:
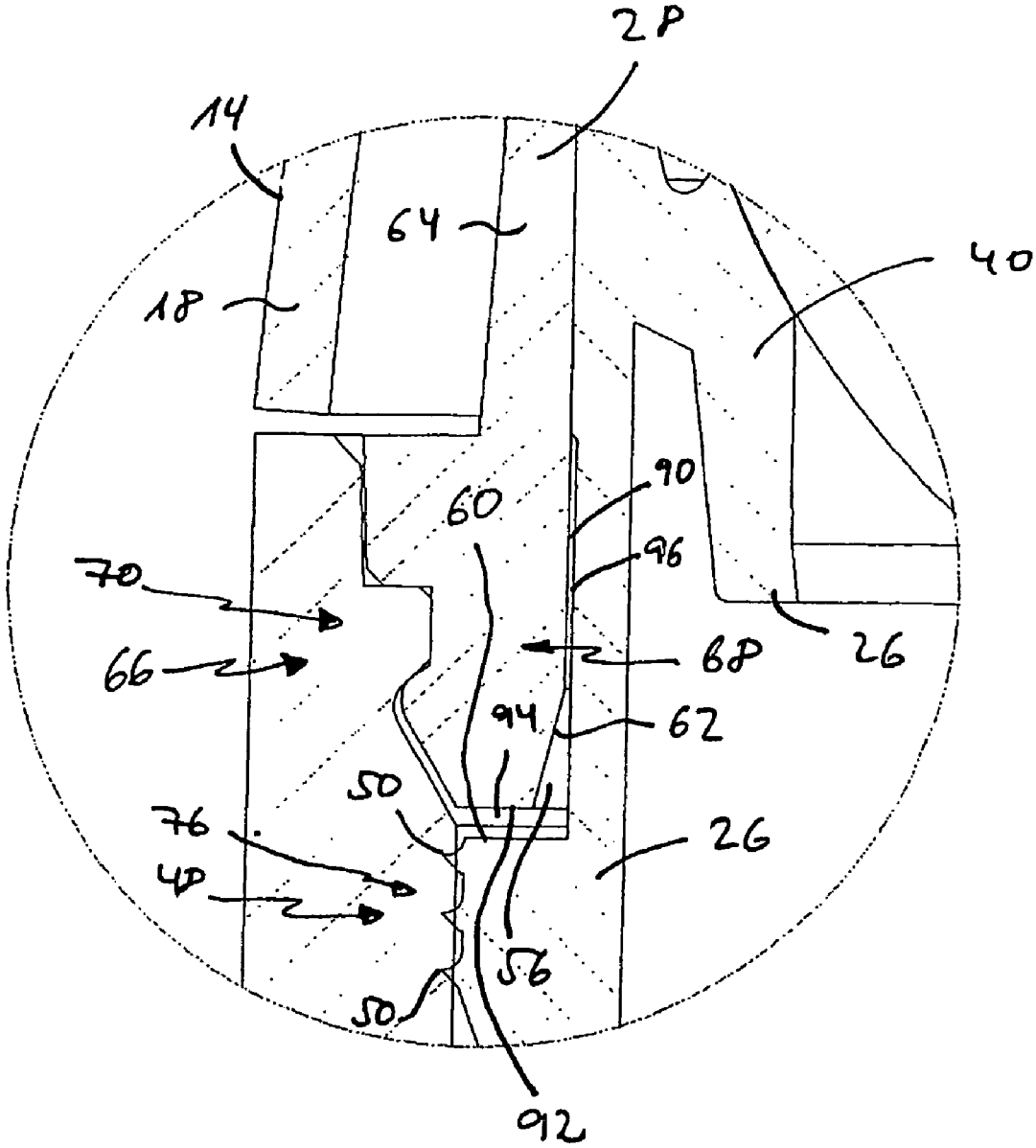
FIG. 3 shows an enlarged segment X from FIG. 2.

FIG. 3 shows segment X from FIG. 2 in an enlarged view.

As the exemplary embodiment shows, first sealing segment 48 of roller receiving device 2—which, acting together with second sealing segment 52 of container 10, forms sealing device 76 for sealing roller receiving device 2 relative to container 10—is situated on a first part 26 of roller receiving device 2, and first holding segment 66—which, working together with a second holding segment 68 situated on container 10, forms a locking connection 70—is situated on a second part 28 of roller receiving device 2. First sealing segment 48 and first holding segment 66 are therefore situated on different parts of roller receiving device 2.

The exemplary embodiment shows that first sealing segment 48 and first holding segment 66 of roller receiving device 2, or sealing device 76 for sealing roller receiving device 2 relative to container 10 and locking device or locking connection 70 for holding roller receiving device 2 on container 10, are functionally separate from one another. The sealing effect is therefore not, or not only, exerted via locking device 70. Locking device 70 can also be fashioned so that it has no sealing effect, or no significant sealing effect.

The exemplary embodiment shows that locking device 70 is situated at a distance from sealing device 70, or first holding segment 66 is situated at a distance from first sealing segment 48. Here, this is such that first sealing segment 48 (seen in the axial direction) is situated on the side of first holding segment 66 that faces container interior 78.

The exemplary embodiment also shows that first holding segment 66 is decoupled, or essentially decoupled, from first sealing segment 48, or the sealing device 76 is decoupled or essentially decoupled from locking connection 70.

As the enlarged segment according to FIG. 3 shows, an intermediate space 94 or spacing is provided axially between lower end 92, facing the container interior, of second fitment part 28 and the horizontally situated segment 60 that limits recess 56 in the direction of the side facing container interior 78. In addition, this enlarged segment according to FIG. 3 shows that in the (axial) area in which first holding segment 66 of roller receiving device 2 is situated, second fitment part 28 is situated at a distance from first fitment part 26 in the radial direction in such a way that a radial intermediate space 90 is provided there between this second fitment part 28 and this first fitment part 26. In particular, this intermediate space 90 is formed, or additionally formed, in that a peripheral recess 96 is formed inside recess 56, in the outer surface of first fitment part 26. Instead of this, or supplementing this, it can be provided that in the corresponding axial area a recess is formed in the inner surface of second fitment part 28. On the side of recess 96 facing away from the interior of the container, second fitment part 28 essentially radially abuts first fitment part 26 inside recess 56.

It can be provided that first fitment part 26 is made from a different material than is second fitment part 28. It can be provided that first fitment part 26 and/or second fitment part 28 and/or container 10 and/or cover 14 and/or roller 12 are made of plastic.

It can be provided that first fitment part 26 is made of a soft material, for example PE. In addition, it can be provided that second fitment part 28 is made of a hard, or comparatively hard, material; second fitment part 28 can for example be made of PP. Container 10 can for example be made of a hard material; it can for example be made of PP. It can be provided that roller 12 is made of a hard material, for example a PP.

The enlarged segment shown in FIG. 3 can also be called a decoupling zone. In particular in the exemplary embodiment, external force or pressure the influences act that do not influence or influence to a reduced degree in comparison with known constructions having a one-piece fitment the tightness between container 10 and roller receiving device 2 or first fitment part 26.

A good locking connection with good tightness is enabled.

FIG. 4 shows first fitment part 26 in an enlarged view.

The invention claimed is:

1. A roller receiving device for a packaging system for fluids, the packaging system comprising: a container for receiving a fluid; a roller and a roller receiving device for receiving the roller and for holding the roller on the container, the roller receiving device has a first part for receiving the roller in the first part, as well as a second part, different from the first part and held radially outwardly on the first part, the first part forming a first sealing segment for sealing the roller receiving device relative to the container, and the second part forming a first holding segment for forming a locking connection between the roller receiving device and the container.

2. The roller receiving device as recited in claim 1, wherein the first part is made from a different material than is the second part.

3. The roller receiving device of claim 1, wherein the first seating segment and the first holding segment being functionally separate and/or situated at a distance from one another and/or essentially decoupled from one another.

4. The roller receiving device, of claim 1, wherein the first part for receiving the roller is made of a soft material and the second part held thereon, which forms a first holding segment for the formation of a locking connection between the roller receiving device and the container, is made of a hard material.

5. The roller receiving device as recited in claim 1, wherein the first part is essentially closed around its periphery, and forms, essentially radially on its inside, an area for receiving the roller.

6. The roller receiving device as recited in claim 1, wherein the first part is essentially closed around its periphery.

7. The roller receiving device as recited in claim 1, wherein the second part is held captively in the first part in the axial direction.

8. The roller receiving device as recited in claim 1, wherein the first sealing segment is formed by a plurality of peripheral fins or sealing lips that protrude radially outward from the first part and are situated at a distance from one another axially.

9. The roller receiving device as recited in claim 1, wherein the first sealing segment of the roller receiving device is situated in the axial direction on the side facing the container of the first holding segment of the roller receiving device.

10. The roller receiving device as recited in claim 1, wherein in the area of the first holding segment between the second part and the first part, a radial intermediate space is provided, and/or on the end facing the container of the second part an axial intermediate space is provided between the second part and the first part.

11. The roller receiving device as recited in claim 1, wherein the first holding segment of the roller receiving device is formed by at least one surface profile raised part that is peripherally continuous, or at least one surface profiling recess that is peripherally continuous.

12. The roller receiving device as recited in claim 1, wherein the end area, facing away from the container interior , of the first part of the roller receiving device is formed by a wall segment that is concavely curved radially inwardly.

13. A packaging system having a container for receiving a fluid, having an opening and having a roller receiving device for receiving a roller as recited in claim 1, and having the roller, held in movable fashion by this roller receiving device, for dispensing fluid from the interior of the container, the roller receiving device being held on the container by the locking connection, and being sealed relative to the container, a sealing device is different from and/or essentially decoupled from this locking connection is provided for the sealing of the roller receiving device relative to the container.

14. The packaging system as recited in claim 13, wherein the container has a second holding segment formed by at least one raised profile part that is preferably peripherally continuous, and/or by at least one profiling recess that is preferably peripherally continuous, this segment forming, in cooperation with the first holding segment of the roller receiving device, the locking connection via which the roller receiving device is held on the container.

15. The packaging system as recited in claim 13, wherein on a jacket wall of the container a second sealing segment is provided that, in cooperation with the first sealing segment of the roller receiving device, forms the sealing device for sealing the roller receiving device relative to the container.

16. The packaging system as recited in claim 13, wherein a sealable cover, is provided that is preferably removable.

17. The packaging system as recited in claim 16, wherein the cover has a transport securing device for the roller for the additional securing of the roller in the roller receiving device when the cover is closed.

18. The packaging system as recited in claim 16, wherein the cover has a pressure device, for the sealing pressing of the first part of the roller receiving device against the roller when the cover is closed.

19. The packaging system as recited in claim 13, wherein the container has a one-piece construction.

20. A roller receiving device for a packaging system for fluids, the packaging system comprising: a container for receiving a fluid; a roller and a roller receiving device for receiving the roller and for holding the roller on the container, the roller receiving device forms a first sealing segment for sealing the roller receiving device relative to the container, and forms a first holding segment for the formation of a locking connection between the roller receiving device and the container, the first holding segment being held radially outwardly on the first sealing segment, the first sealing segment and the first holding segment being functionally separate and/or situated at a distance from one another and/or essentially decoupled from one another.

* * * * *